US008079741B2

(12) United States Patent
Stark

(10) Patent No.: US 8,079,741 B2
(45) Date of Patent: Dec. 20, 2011

(54) LAMP WITH A BUILT-IN LAMP

(75) Inventor: Roland Stark, Wellheim (DE)

(73) Assignee: OSRAM AG, München (DE)

( * ) Notice: Subject to any disclaimer, the term of this patent is extended or adjusted under 35 U.S.C. 154(b) by 768 days.

(21) Appl. No.: 12/224,740

(22) PCT Filed: Feb. 28, 2007

(86) PCT No.: PCT/EP2007/051905

§ 371 (c)(1),
(2), (4) Date: Sep. 2, 2008

(87) PCT Pub. No.: WO2007/099124

PCT Pub. Date: Sep. 7, 2007

(65) Prior Publication Data

US 2011/0235344 A1 Sep. 29, 2011

(30) Foreign Application Priority Data

Mar. 2, 2006 (DE) ..... 20 2006 003 314 U

(51) Int. Cl.
*H01R 33/00* (2006.01)
*H01J 5/48* (2006.01)

(52) U.S. Cl. .... 362/457; 362/374; 313/317; 313/318.01

(58) Field of Classification Search ..... 362/374, 362/375, 549, 457, 261, 262, 263; 313/317, 313/318.01–318.09, 318.1, 318.11, 318.12
See application file for complete search history.

(56) References Cited

U.S. PATENT DOCUMENTS

| | | | | |
|---|---|---|---|---|
| 5,043,624 | A * | 8/1991 | Hirozumi et al. | 313/318.09 |
| 5,239,226 | A * | 8/1993 | Seredich et al. | 313/318.01 |
| 5,550,422 | A * | 8/1996 | Sulcs et al. | 313/25 |
| 6,031,323 | A * | 2/2000 | Behr et al. | 313/318.01 |
| 7,439,662 | B2 * | 10/2008 | Arndt et al. | 313/318.09 |
| 2006/0077648 | A1 * | 4/2006 | Stark | 313/318.09 |

FOREIGN PATENT DOCUMENTS

| | | | |
|---|---|---|---|
| DE | 4305503 | A1 | 8/1994 |
| DE | 19709928 | A1 | 9/1998 |
| EP | 1329931 | A | 7/2003 |
| EP | 1542256 | A | 6/2005 |
| FR | 2717956 | A | 9/1995 |
| JP | 01 1139354 | U | 7/1989 |

* cited by examiner

*Primary Examiner* — Bao Q Truong
(74) *Attorney, Agent, or Firm* — Cozen O'Connor

(57) ABSTRACT

A lamp with a built-in lamp which is inserted into a base via a mounting clip and is surrounded by an enveloping bulb. The base and the enveloping bulb are joined via a joining compound or using a clamping technique. The mounting clip has securing elements, via which the enveloping bulb is held on the base once the joint has loosened.

15 Claims, 6 Drawing Sheets

LAMP WITH A BUILT-IN LAMP

Related Applications

This is a U.S. national stage of application No. PCT/EP2007/051905, filed on Feb. 28, 2007.

This patent application claims the priority of German patent application no. 20 2006 003 314.9 filed Mar. 2, 2006, the disclosure content of which is hereby incorporated by reference.

FIELD OF THE INVENTION

The invention relates to a lamp with a built-in lamp, in particular a built-in halogen lamp, which is inserted into a base via a mounting clip and is surrounded by an enveloping bulb, the base and the enveloping bulb being joined via a joining compound or using a clamping technique.

BACKGROUND OF THE INVENTION

Halogen incandescent lamps are in increasingly widespread use in many sectors of daily life owing to their good light quality and long life. Even in applications with stringent requirements placed on aesthetics and efficiency, it has become desirable to replace conventional incandescent lamps functioning with a mains voltage with halogen incandescent lamps. For these reasons, lamps with inserted halogen incandescent lamps which are surrounded by an enveloping bulb and as a result can externally barely be distinguished from conventional incandescent lamps for general lighting have been developed.

Such a lamp is described, for example, on the website www.osram.de under the product designation "HALOLUX® T". In the case of these conventional lamps, a built-in halogen lamp with a pinch seal at one end is inserted into a base via an electrically conductive mounting clip and surrounded by an enveloping bulb, the base and the enveloping bulb being joined via a joining compound, for example an adhesive or cement. The mounting clip in this case takes on the function of both making electrical contact with and mechanically fixing the built-in lamp in the base.

One disadvantage with the above-described solution is that the joint between the enveloping bulb and the base may loosen owing to aging or embrittlement of the joining compound, for example, with the result that the enveloping bulb is completely separated from the base and life-endangering touching contact with the now exposed live mounting clip in the lamp interior may arise. Furthermore, there is a considerable risk of injury for the user as a result of splinters from the enveloping bulb which is smashed when dropped.

SUMMARY OF THE INVENTION

One object of the present invention is to provide a lamp with a built-in lamp, in particular a built-in halogen lamp, in which protection against touching contact with the live components in the event of the enveloping bulb becoming detached is made possible in contrast to conventional solutions.

This and other objects are attained in accordance with one aspect of the present invention directed to a lamp with a built-in lamp, in particular a built-in halogen lamp, which is inserted into a base via a mounting clip and is surrounded by an enveloping bulb, the base and the enveloping bulb being joined via a joining compound or using a clamping technique, the mounting clip having securing elements, via which the enveloping bulb is held on the base once the joint has loosened.

A lamp according to an embodiment of the invention has a built-in lamp, in particular a built-in halogen lamp, which is inserted into a base via a mounting clip and is surrounded by an enveloping bulb, the base and the enveloping bulb being joined via a joining compound, for example an adhesive, cement or the like, or using a clamping technique. The mounting clip has securing elements via which the enveloping bulb is held on the base once the joint has loosened. Owing to the securing elements, the enveloping bulb cannot be detached completely from the base once the adhesive, cement or clamping joint between the enveloping bulb and the base has loosened, with the result that the live mounting clip continues to be protected against unintentional touching contact by means of the enveloping bulb and the risk of electric shock is ruled out.

In accordance with a particularly preferred exemplary embodiment, the mounting clip has at least two spring lugs as securing elements.

It has proven to be particularly advantageous if the spring lugs are elastically flexible for joining the enveloping bulb to the base and, once the joint has loosened, are capable of being brought to bear from the inside against an enveloping bulb neck of the enveloping bulb.

Preferably, the spring lugs are arranged approximately diametrically with respect to one another.

In a preferred exemplary embodiment, the spring lugs are bent out of a circumferential wall of the mounting clip and extend substantially in the radial direction outwards and in the direction of the base. As a result, it is easier to push the enveloping bulb on, with the spring lugs bending elastically in the direction of the mounting clip and, after fitting of the enveloping bulb, protruding as a type of barb and preventing a loose enveloping bulb from falling off.

In an embodiment of the invention, at least sections of the spring lugs are arcuate in order to make it even easier to push the enveloping bulb on and to improve the supporting effect of the spring lugs on the loose enveloping bulb.

Preferably, the mounting clip has an accommodating section, which is approximately in the form of a cylinder casing, for inserting the built-in lamp, which accommodating section, in accordance with a particularly preferred embodiment of the invention, is formed by cutouts, which are arranged diametrically with respect to one another and in which a region, which is flattened in planar-parallel fashion, of a pinch seal of the built-in lamp can be clamped, extended peripheral sections, which adjoin the flattened region, of the pinch seal coming to lie outside the accommodating section.

Preferably, circumferential sections, which delimit the cutouts, of the circumferential wall of the mounting clip are bent inwards towards one another and run approximately perpendicular to the two plane faces of the pinch seal.

In a preferred exemplary embodiment, the cutouts each have two spring elements, which are arranged opposite one another and can be brought to bear against the flattened region of the pinch seal via two spring limbs, which extend substantially in the axial direction and are arranged opposite one another, and between which spring elements the pinch seal of the built-in lamp can be clamped. In other words, the spring limbs of the spring elements bear in a sprung manner against the two planar-parallel faces of the pinch seal and fix the latter centrally in the accommodating section of the mounting clip. The spring limbs in the process make it possible to compensate for the manufacturing tolerances of the pinch seal and are used for centering the built-in lamp in the mounting clip and for fastening it in clamping fashion.

In accordance with an exemplary embodiment of the invention, the upper spring limbs facing the built-in lamp are bent back in the form of runners and form an insertion bevel, onto which cam-like projections arranged on the pinch seal run when the built-in lamp is inserted. The insertion bevels make it easier to insert the pinch seal during fitting of the built-in lamp and, via the running projections, limit the penetration depth thereof into the mounting clip.

At least sections of the lower spring limbs facing the base are bent back parallel to the plane faces of the pinch seal, with the result that a considerable clamping effect is made possible with at the same time easier insertion of the pinch seal.

It has proven to be particularly advantageous in terms of manufacturing to design the mounting clip to be in the form of a stamped and bent sheet-metal part, at least sections of which have an approximately circular cross section.

In the case of screw-type bases with a similar inner diameter in relation to the outer diameter of the mounting clip, for example E14 screw-type bases, the mounting clip can be screwed into the base via a fastening section, which is provided with circumferential screw-in projections. Alternatively, the mounting clip can also be compressed with the base. This variant is particularly used in the case of larger bases, for example E27 bases, in which case a transition clip is positioned onto the mounting clip and is compressed with the base.

The screw-in depth of the mounting clip into the base is preferably limited by limiting elements of the mounting clip bearing against an annular face of the base. Owing to the limiting elements, axial centering of the mounting clip in the base is likewise achieved.

In accordance with a preferred exemplary embodiment, the built-in lamp has two power supply lines, with a first power supply line of the built-in lamp being electrically connected to the mounting clip, and a second power supply line being electrically connected to a bottom contact of the base via a power supply wire. By means of the power supply lines, electrical contact is made with the built-in lamp and the latter is fixed axially in the lamp.

BRIEF DESCRIPTION OF THE DRAWINGS

The invention will be explained in more detail below with reference to a preferred exemplary embodiment. In the drawings.

PREFERRED EMBODIMENT OF THE INVENTION

Figure 1:
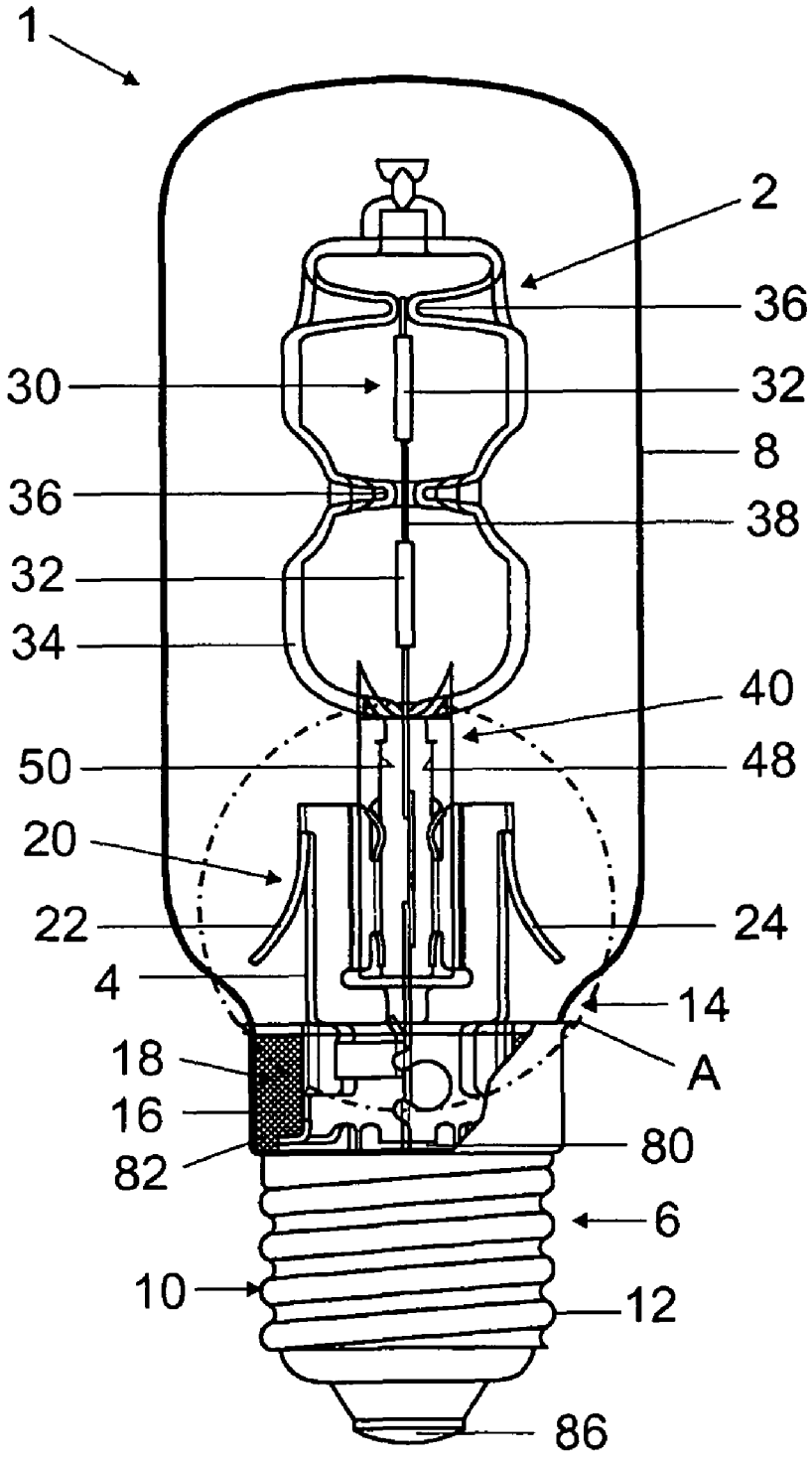
FIG. 1 shows a side view of a lamp according to the invention with the built-in lamp inserted.

FIG. 1 shows a side view of a lamp 1 according to the invention with a built-in lamp 2, which is mechanically and electrically connected to a base 6 via a mounting clip 4 and is surrounded by an enveloping bulb 8. In the exemplary embodiment illustrated, the base 6 is in the form of a screw-type base of the type E14 and has an approximately pot-shaped stepped base sleeve 12, which is provided with a screw-in thread 10 and whose inner diameter is matched to the outer diameter of the mounting clip 4. The enveloping bulb 8 is tapered towards the base 6 to form an enveloping bulb neck 14, which is approximately in the form of a cylinder casing and whose outer diameter is designed to be slightly smaller than the inner diameter of the circumferential wall of the base sleeve 12, with the result that the base sleeve 12 grips around this cylinder casing section in the installed state. The enveloping bulbs 8 used can have any bulb shape known from the general prior art, for example a drop shape, candle shape or mushroom shape, or may be in the form of a tubular bulb 8 as per FIG. 1. Depending on the application, glass bulbs 8 which are frosted, clear or silicated or partially silicated for increased scattering effect are used. In order to join the enveloping bulb 8, the mounting clip 4 and the base 6, a joining compound 16, for example an adhesive or cement, is introduced into an annular space delimited by the base sleeve 12 and the mounting clip 4, with the result that, once the joining compound 16 has cured, a high-strength joint between these components is ensured. In one variation (not illustrated) of the invention, the enveloping bulb 8 is joined to the base sleeve 12 using a clamping technique instead of the adhesive bond.

According to the invention, the mounting clip 4 is provided with securing elements 20, via which the enveloping bulb 8 is held on the base 6 once the adhesive bond or cement joint has loosened, for example as a result of aging or embrittlement of the joining compound 16. As will be explained in more detail below, the enveloping bulb 8 cannot be completely separated from the base 6 once the joint has loosened owing to the securing elements 20, with the result that the live mounting clip 4 is also protected against unintentional touching contact once the adhesive bond or cement joint has loosened by means of the enveloping bulb 8, and the risk of electric shock is ruled out.

Figure 2:
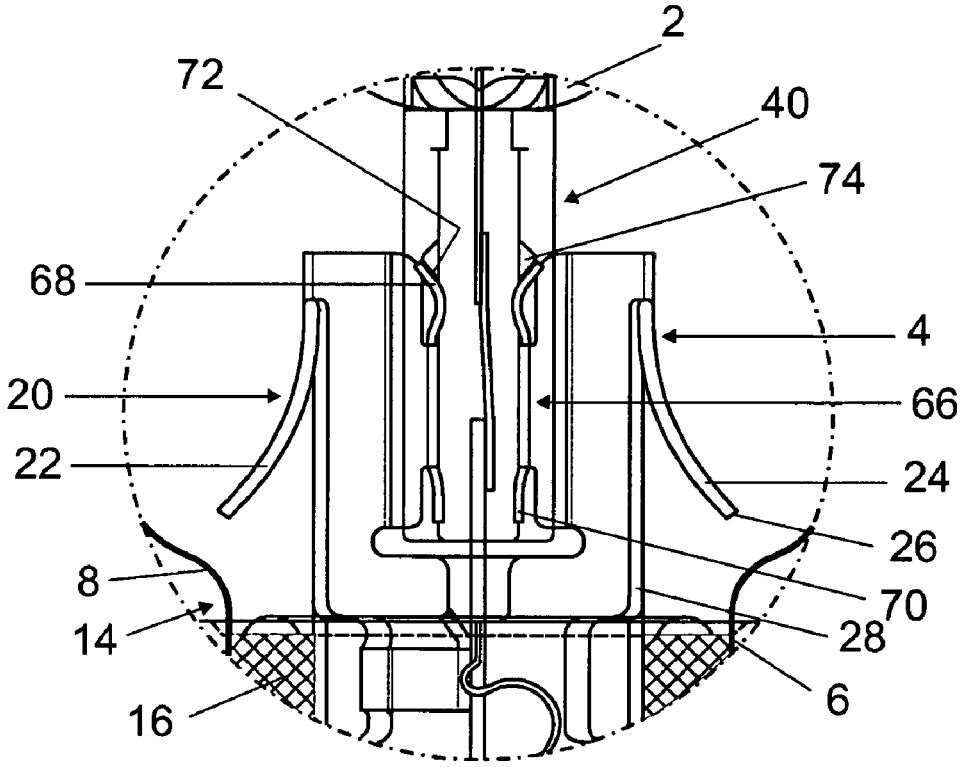
FIG. 2 shows a view of the detail A from FIG. 1.

As can be seen in particular in FIG. 2, which shows a view of the detail A from FIG. 1, in the exemplary embodiment illustrated two spring lugs 22, 24, which are arranged diametrically with respect to one another, are used as the securing elements 20. Said spring lugs 22, 24 are elastically flexible for the purpose of joining the enveloping bulb 8 to the base 6 and, once the adhesive bond or cement joint has loosened, can be brought to bear against the enveloping bulb 8 in the region of the enveloping bulb neck 14 from the inside via end faces 26, with the result that the enveloping bulb 8 cannot be completely separated from the base 6. The spring lugs 22, 24 are bent out of a circumferential wall 28 of the mounting clip 4 and extend in the radial direction in arcuate fashion outwards approximately in the direction of the base 6. This makes it easier to push the enveloping bulb 8 on, with the spring lugs 22, 24 bending elastically in the direction of the mounting clip 4 and, once the enveloping bulb 8 has been fitted, projecting into the position illustrated in order to be supported via the end faces 26 against the enveloping bulb neck 14 on the inside once the adhesive bond or cement joint has loosened, which may happen, and to secure the enveloping bulb 8 on the base 6.

Figure 3:
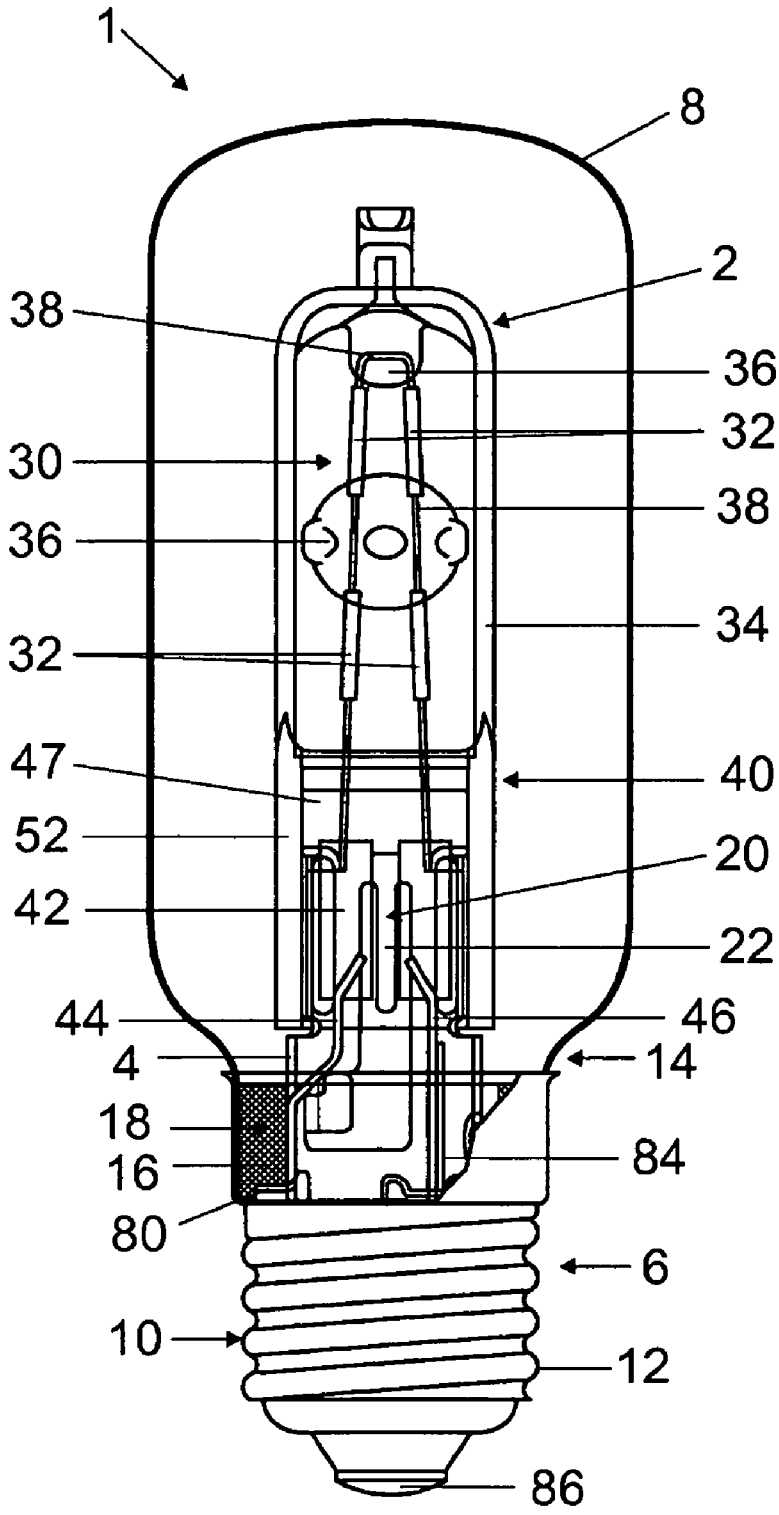
FIG. 3 shows a front view of the lamp from FIG. 1.

As shown in the side view of the lamp 1 according to the invention shown in FIG. 3, the built-in lamp 2 in the exemplary embodiment shown is in the form of a halogen incandescent lamp (halogen burner) with a conventional design. Such a halogen incandescent lamp 2 substantially comprises an incandescent filament 30, which is provided with, for example, four filament sections 32 and is fixed in position in a lamp vessel 34 using pinch technology. For this purpose, retaining pinches 36 are introduced into the wall of the lamp vessel diametrically opposite one another (see FIG. 1) and clamp in connecting parts 38 of the filament sections 38 between the end faces of the retaining pinches 36 in order to fix the incandescent filament 30. This pinch technology is described in detail, for example in EP 0 446 460 B1 by the applicant, which means that further explanations are not required. The lamp vessel 34 is sealed off via a pinch seal 40 at one end, in which the two end sections of the incandescent filament 30 are connected to power supply lines 44, 46, which are passed out of the pinch seal 40, via in each case one molybdenum foil 42. The pinch seal 40 is designed in such a way that the central region 47 in FIG. 3 is designed to have planar-parallel faces 48, 50 (perpendicular to the plane of the drawing in FIG. 1), which become peripheral sections 52, 54, which protrude on both sides beyond the two plane faces 48, 50 perpendicular to the plane of the drawing in FIG. 3, with the result that the cross section (not illustrated) of the pinch seal 40 is approximately in the form of a double T with the extended peripheral sections 52, 54 and the region 47, which is positioned therebetween and is delimited by the two faces 48, 50, which run in planar-parallel fashion.

Figure 4:
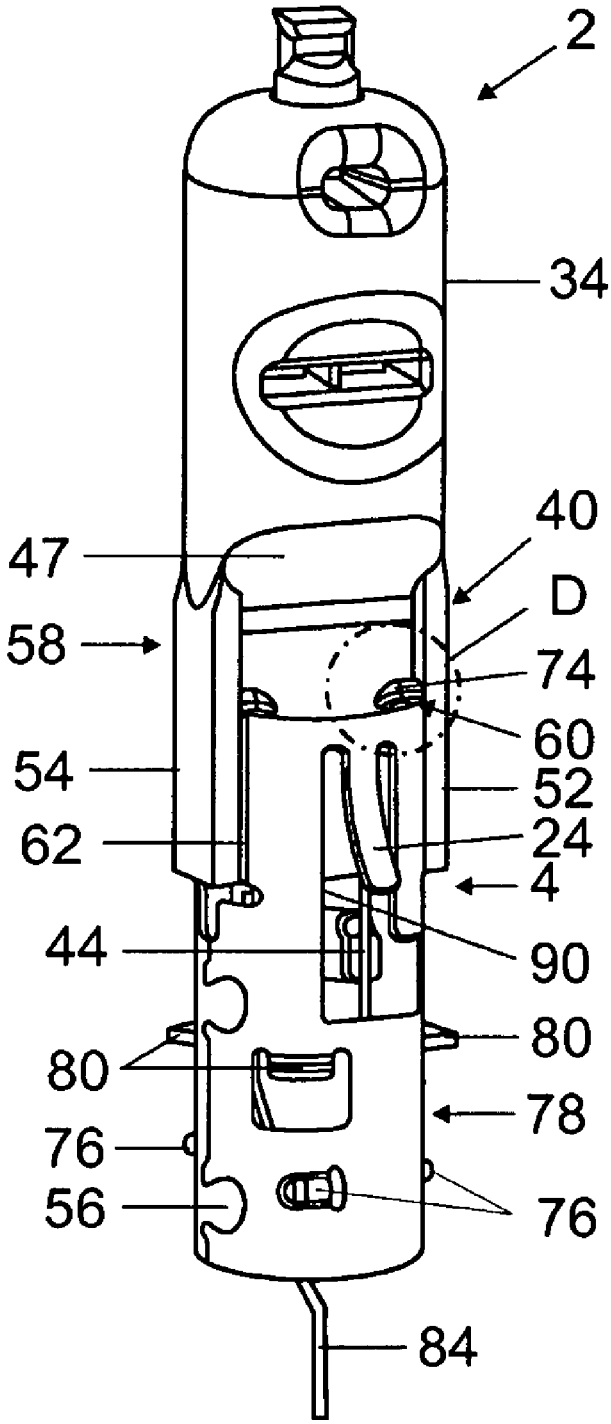
FIG. 4 shows a three-dimensional illustration of the mounting clip with the built-in lamp inserted.

As can be seen in particular in FIG. 4, which shows a three-dimensional illustration of the mounting clip 4 with the built-in lamp 2 inserted, the mounting clip 4 is shaped from a stamped sheet-metal part to form a tube or cylinder casing which is matched to the inner diameter of the base, with this tube or cylinder casing being held together in a force-fitting and form-fitting manner via engagement elements 56 with a recess. At its end facing the built-in lamp 2 (at the top in FIG. 4), the mounting clip 4 has an accommodating section 58, which is approximately in the form of a cylinder casing and into which the pinch seal 40 of the built-in lamp 2 is inserted. In the exemplary embodiment described, this accommodating section 58 is formed by slot-shaped cutouts 60, which are arranged diametrically with respect to one another and in which the region 47, which is flattened in planar-parallel fashion, of the pinch seal 40 of the built-in lamp 2 can be clamped, the extended peripheral sections 52, 54, which adjoin the flattened region, of the pinch seal 40 coming to lie outside the accommodating section 58.

Figure 5:
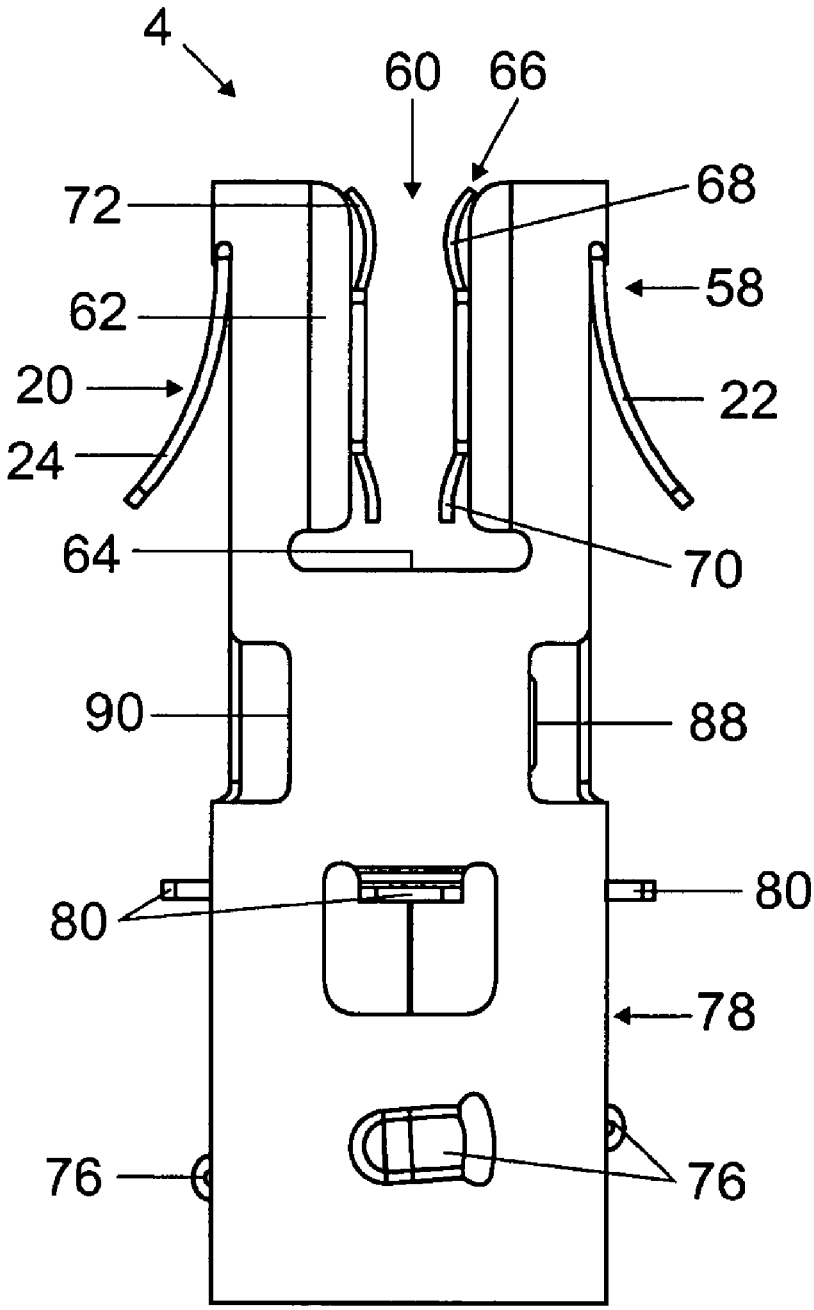
FIG. 5 shows an individual illustration of the mounting clip from FIG. 4.

As shown in FIG. 5, which shows an individual illustration of the mounting clip 4 from FIG. 4, circumferential sections 62, which delimit the cutouts 60, of the mounting clip casing 28 are bent inwards towards one another, with the result that they run approximately perpendicular to the two plane faces 50 of the pinch seal 40 (see FIG. 4). The cutouts 60 in each case become an extended region 64 at the bottom, which extended region 64 makes it possible for the circumferential sections 62 of the two cutouts 60 to be bent back inwards. In order for the built-in lamp 2 to be held in a force-fitting manner, end regions of the circumferential sections 62 of the cutouts 60 are stamped free when the sheet-metal casing is stamped and then bent inwards at right angles, with the result that they form two spring elements 66, which are arranged opposite one another, bear in a sprung manner against the flattened region 47 of the pinch seal 40 via in each case two spring limbs 68, 70, which extend substantially in the axial direction and are arranged opposite one another, as shown in FIG. 2, and clamp in the pinch seal 40 of the built-in lamp 2. The spring limbs 68, 70 make it possible to compensate for the manufacturing tolerances of the pinch seal 40 and are used for centering the built-in lamp 2 in the mounting clip 4 and as retaining points for the clamping fastening of the built-in lamp 2. As can be seen in particular from FIG. 4, the bent-back circumferential sections 62 of the two cutouts 60 engage behind the two projecting peripheral sections 52, 54 of the pinch seal 40, which are then arranged outside the accommodating section 58 of the mounting clip 4, when the built-in lamp 2 is inserted. This means that the pinch seal 40 passes through the accommodating section 58 of the mounting clip 4 diagonally, the spring elements 66 resting on the plane faces 48, 50 of the pinch seal 40 via the spring limbs 68, 70, with the result that the built-in lamp 2 is fixed in position in the radial direction.

Figure 6:
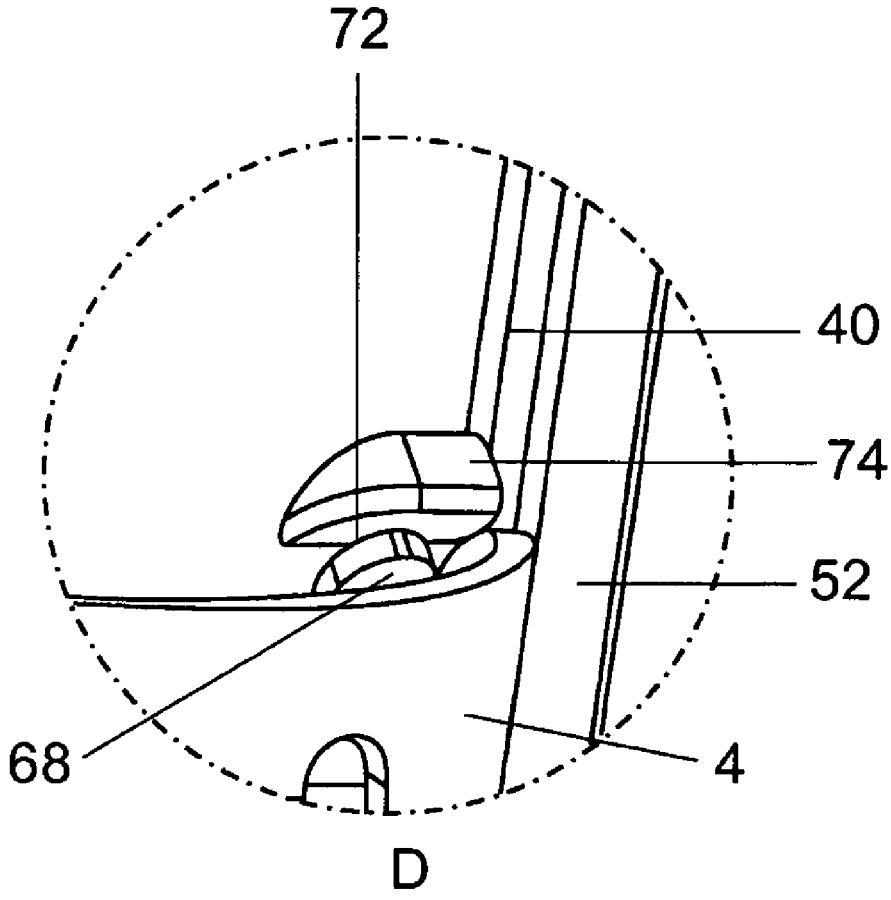
FIG. 6 shows a view of the detail D from FIG. 4.

As can be seen in particular from FIG. 2 and FIG. 6, which shows a view of the detail D from FIG. 4, the upper spring limb 68 of the spring elements 66 are bent back in the form of runners so as to improve the clamping effect and to simplify the fitting of the built-in lamp and form insertion bevels 72, onto which cam-like projections 74, which are arranged on the pinch seal 40, run when the built-in lamp 2 is inserted. The insertion bevels 72 make it easier for the pinch seal 40 to be inserted when the built-in lamp 2 is fitted and to limit, via the projections 74 running on them, the penetration depth thereof into the mounting clip 4. Sections of the lower spring limbs 70 facing the base 6 are bent back parallel to the plane faces 48, 50 of the pinch seal 40, with the result that a considerable clamping effect is made possible with at the same time easier insertion of the pinch seal 40. The applicant reserves the right to direct dedicated independent claims at the spring elements 66 for accommodating the built-in lamp 2.

At its end facing the base 6, the mounting clip 4 shown in FIG. 4 and FIG. 5 has a fastening section 78, which is provided with three circumferential screw-in projections 76, which are arranged in each case offset through 120° with respect to one another, via which fastening section 78 the mounting clip 4, in the case of the E14 screw-type base 6 illustrated with an inner diameter which is similar in comparison to the outer diameter of the mounting clip 4, is screwed directly into the bases 6 (see FIGS. 1 and 3). For this purpose, the screw-in projections 76 are on a thread turn which is designed so as to correspond to the screw-in thread 10 of the E14 base 6. The screw-in depth of the mounting clip 4 is in this case limited by three lug-shaped limiting elements 80, which are arranged offset with respect to one another through in each case 120° in a common radial plane and are bent out of the mounting clip casing and on which an annular face 82 of the base sleeve 12 bears in the fitted state from below (view shown in FIGS. 1 and 3).

Alternatively, the mounting clip 4 can also be compressed with the base 6. This variant is used particularly in the case of relatively large bases, for example E27 bases, in which case a transition clip is positioned onto the mounting clip 4 and is compressed with the base or joined via a joining compound.

As can be seen in particular in FIG. 3, the built-in lamp 2 has two power supply lines 44, 46, a first power supply line 44 of the built-in lamp 2 being electrically connected to the mounting clip 4, and a second power supply line 46 being electrically connected to a bottom contact 86 of the base 6 via a power supply wire 84. When the built-in lamp 2 is fitted in the mounting clip 4, the power supply line 44 is connected by means of welding to a welding tab 88 (see FIG. 4) of the mounting clip 4. As shown in FIG. 3, the power supply wire 84 is welded to the other power supply line 46, protrudes downwards, as an extension of the power supply line 46, through the interior of the mounting clip 4 into the base 6 and is electrically connected there to the bottom contact 86. This means that the built-in lamp 2 is fixed in position axially by means of power supply lines 44, 46, which are welded to the mounting clip 4 or to the bottom contact 86 via a power supply wire 84. In order to make the welding point accessible, two diametrically arranged apertures 90 (see FIG. 4) are introduced into the circumferential wall 28 of the mounting clip 4, which apertures 90 were stamped during the stamping of the sheet-metal casing.

Finally, the text which follows will explain, by way of example, the manufacture of the lamp 1. In a first working step, the power supply wire 84 is welded to the power supply line 46 of the built-in lamp 2. Then, the built-in lamp 2 is inserted into the mounting clip 4, with the result that the pinch seal 40 passes diagonally through the cutouts 60 and is centered and fixedly clamped via the spring limbs 68, 70, which protrude in the direction of the pinch seal 40, of the spring elements 66. In a further working step, the power supply line 44 is welded to the welding tab 88 of the mounting clip 4 through the apertures 90, with the result that the built-in lamp 2 is held axially in the mounting clip 4. Then, in the region of the annular face 82, the joining compound 16, for example an adhesive or cement, is introduced into the base sleeve 12 and the mounting clip 4 with the built-in lamp 2 inserted is screwed into the base 6 via the screw-in projections 76 until the limiting elements 80 come to bear against the annular face 82 of the base 6. As a result, the screw-in depth is limited and the mounting clip 4 is centered in the base 6. Subsequently, the enveloping bulb 8 is inserted into the base sleeve 12, the joining compound 16 being forced slightly inwards when the enveloping bulb 8 is inserted since the outer circumference of the cylinder casing section bears substantially flush against the inner circumferential wall of the base sleeve 12. Then, the joining compound 16 is cured in a furnace or in a heating section, and the power supply wire 84 which protrudes in the axial direction is cut to length and soldered to the bottom contact 86 of the lamp 1.

The lamp 1 according to the invention is not restricted to the built-in halogen lamp 2 described and the screw-type base 6, but rather the invention can be used with different built-in lamp types and base types known from the prior art, in particular, with built-in lamps with a base at two ends. Furthermore, the built-in lamp 2 can be held in clamping fashion in the mounting clip 4 in any desired manner, for example merely by means of bearing circumferential edges or regions of the cutouts 60.

The invention discloses a lamp 1 with a built-in lamp 2, in particular a halogen built-in lamp, which is inserted into a base 6 via a mounting clip 4 and is surrounded by an enveloping bulb 8, the base 6 and the enveloping bulb 8 being joined via a joining compound 16 or using a clamping technique. According to the invention, the mounting clip 4 has securing elements 20, via which the enveloping bulb 8 is held on the base 6 once the joint has loosened.

The invention claimed is:

1. A lamp with a built-in lamp which is inserted into a base via a mounting clip and is surrounded by an enveloping bulb, the base and the enveloping bulb being joined via a joining compound or using a clamping technique, wherein the mounting clip has securing elements, via which the enveloping bulb is held on the base once the joint has loosened.

2. The lamp as claimed in claim 1, the mounting clip having at least two spring lugs as securing elements.

3. The lamp as claimed in claim 2, the spring lugs being elastically flexible for joining the enveloping bulb to the base and, once the joint has loosened, being capable of being brought to bear from the inside against an enveloping bulb neck of the enveloping bulb.

4. The lamp as claimed in claim 2, the spring lugs being arranged approximately diametrically with respect to one another.

5. The lamp as claimed in claim 2, the spring lugs being bent out of a circumferential wall of the mounting clip and extending substantially in the radial direction outwards and in the direction of the base.

6. The lamp as claimed in 2, at least sections of the spring lugs being arcuate.

7. The lamp as claimed claim 1, the mounting clip having an accommodating section, which is approximately in the form of a cylinder casing, for inserting the built-in lamp, which accommodating section is formed by cutouts, which are arranged diametrically with respect to one another and in which a region, which is flattened in planar-parallel fashion, of a pinch seal of the built-in lamp can be clamped and extended peripheral sections, which adjoin the flattened region, of the pinch seal come to lie outside the accommodating section.

8. The lamp as claimed in claim 7, circumferential sections, which delimit the cutouts, of the circumferential wall of the mounting clip being bent inwards towards one another and running approximately perpendicular to the plane faces of the pinch seal.

9. The lamp as claimed in claim 7, the cutouts each having two spring elements, which are arranged opposite one another and can be brought to bear against the flattened region of the pinch seal via two spring limbs, which extend substantially in the axial direction and are arranged opposite one another, and between which spring elements the pinch seal of the built-in lamp can be clamped.

10. The lamp as claimed in claim 9, the upper spring limbs facing the built-in lamp being bent back in the form of runners and forming an insertion bevel, onto which cam-like projections arranged on the pinch seal run when the built-in lamp is inserted.

11. The lamp as claimed in claim 9, at least sections of the lower spring limbs facing the base being bent back parallel to the plane faces of the pinch seal.

12. The lamp as claimed in claim 1, the mounting clip being a stamped and bent sheet-metal part and at least sections of it having an approximately circular cross section.

13. The lamp as claimed in claim 1, the mounting clip having a fastening section, which is provided with screw-in projections, which can be brought into threaded engagement with the base.

14. The lamp as claimed in claim 13, the screw-in depth of the mounting clip into the base being limited by limiting elements bearing against an annular face of the base.

15. The lamp as claimed in claim 1, a first power supply line of the built-in lamp being electrically connected to the mounting clip, and a second power supply line being electrically connected to a bottom contact of the base via a power supply wire.

* * * * *